US009536695B2

(12) United States Patent
Liu et al.

(10) Patent No.: US 9,536,695 B2
(45) Date of Patent: Jan. 3, 2017

(54) FIELD EMISSION CATHODE DEVICE AND DRIVING METHOD

(71) Applicants: Tsinghua University, Beijing (CN); HON HAI PRECISION INDUSTRY CO., LTD., New Taipei (TW)

(72) Inventors: Peng Liu, Beijing (CN); Shou-Shan Fan, Beijing (CN)

(73) Assignees: Tsinghua University, Beijing (CN); HON HAI PRECISION INDUSTRY CO., LTD., New Taipei (TW)

( * ) Notice: Subject to any disclaimer, the term of this patent is extended or adjusted under 35 U.S.C. 154(b) by 381 days.

(21) Appl. No.: 13/863,538

(22) Filed: Apr. 16, 2013

(65) Prior Publication Data

US 2014/0184092 A1 Jul. 3, 2014

(30) Foreign Application Priority Data

Dec. 29, 2012 (CN) ..... 2012 1 0587689

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |
| ***H01J 1/304*** | (2006.01) |
| ***H01J 31/12*** | (2006.01) |
| ***H05B 41/14*** | (2006.01) |

(52) U.S. Cl.

CPC ..... *H01J 1/304* (2013.01); *H01J 31/127* (2013.01); *H05B 41/14* (2013.01); *H01J 2201/30469* (2013.01)

(58) Field of Classification Search

CPC ..... H01J 1/304
USPC ..... 315/291
See application file for complete search history.

(56) References Cited

U.S. PATENT DOCUMENTS

| | | | | |
|---|---|---|---|---|
| 5,150,019 A * | 9/1992 | Thomas | H01J 21/105 | 313/309 |
| 7,646,142 B2 * | 1/2010 | Kang | H01J 3/022 | 313/309 |
| 7,785,907 B2 * | 8/2010 | Zheng | B82Y 10/00 | 257/E21.085 |

(Continued)

FOREIGN PATENT DOCUMENTS

| | | |
|---|---|---|
| CN | 1750222 | 3/2006 |
| CN | 102034664 | 4/2011 |

*Primary Examiner* — Lincoln Donovan
*Assistant Examiner* — Metasebia Retebo
(74) *Attorney, Agent, or Firm* — Zhigang Ma

(57) ABSTRACT

A driving method includes providing a field emission cathode device. The field emission cathode device includes a cathode electrode, an electron emission layer electrically connected to the cathode electrode, a first gate electrode spaced from the cathode electrode by a first dielectric layer, and a second grid electrode spaced from the first gate electrode by a second dielectric layer. The second dielectric layer has a second opening. A first voltage is supplied to the cathode electrode, a second voltage is supplied to the first gate electrode, and a third voltage is supplied to the second grid electrode, to extract electrons from the electron emission layer to a space formed by the second opening, until the electrons of the space saturate. The third voltage is greater than the second voltage, such that the electrons of the space are emitted through the second grid electrode.

20 Claims, 7 Drawing Sheets

(56) References Cited

U.S. PATENT DOCUMENTS

| | | | | |
|---|---|---|---|---|
| 2006/0055304 | A1 | 3/2006 | Kang et al. | |
| 2008/0111466 | A1* | 5/2008 | Cho | H01J 1/304 313/495 |
| 2009/0115305 | A1* | 5/2009 | Segal | H01J 3/021 313/300 |
| 2010/0172213 | A1* | 7/2010 | Qian | H04R 23/002 367/140 |
| 2011/0074274 | A1 | 3/2011 | Tang et al. | |

* cited by examiner

FIELD EMISSION CATHODE DEVICE AND DRIVING METHOD

RELATED APPLICATIONS

This application claims all benefits accruing under 35 U.S.C. §119 from China Patent Application No. 201210587689.3, filed on Dec. 29, 2012 in the China Intellectual Property Office, the disclosure of which is incorporated herein by reference.

BACKGROUND

1. Technical Field

The present application relates to a field emission cathode device and a driving method.

2. Discussion of Related Art

A conventional field emission cathode device includes an insulating substrate, a cathode electrode fixed on the insulating substrate, a plurality of electron emitters fixed on the cathode electrode, a dielectric layer fixed on the insulating substrate, and a gate electrode fixed on the dielectric layer. The gate electrode provides an electrical potential to extract electrons from the plurality of electron emitters. When a field emission display using the field emission cathode device is operated, an anode electrode provides an electrical potential to accelerate the extracted electrons to bombard the anode electrode for luminance.

The gate electrode generally has an opening, such that the plurality of electron emitters is exposed. Therefore, the electrons extracted from the plurality of electron emitters will directly go through the opening of the gate electrode to bombard the anode electrode. However, it is difficult to control emission of the extracted electrons to the anode electrode. The emission of the extracted electrons is uneven and unsteady.

What is needed, therefore, is to provide a field emission cathode device and a driving method of the field emission cathode device to overcome the shortcomings.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
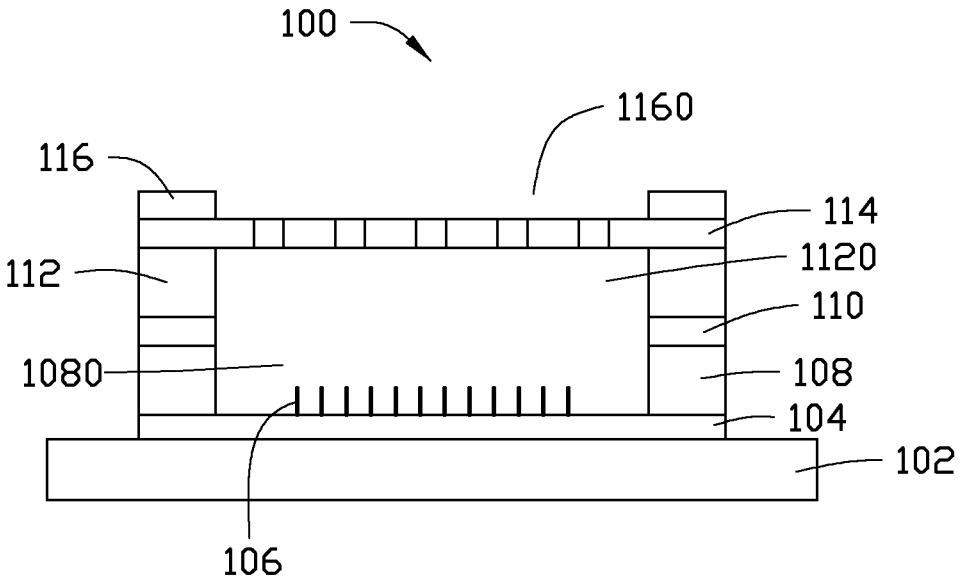
FIG. 1 is a schematic view of one embodiment of a field emission cathode device.
Figure 2:
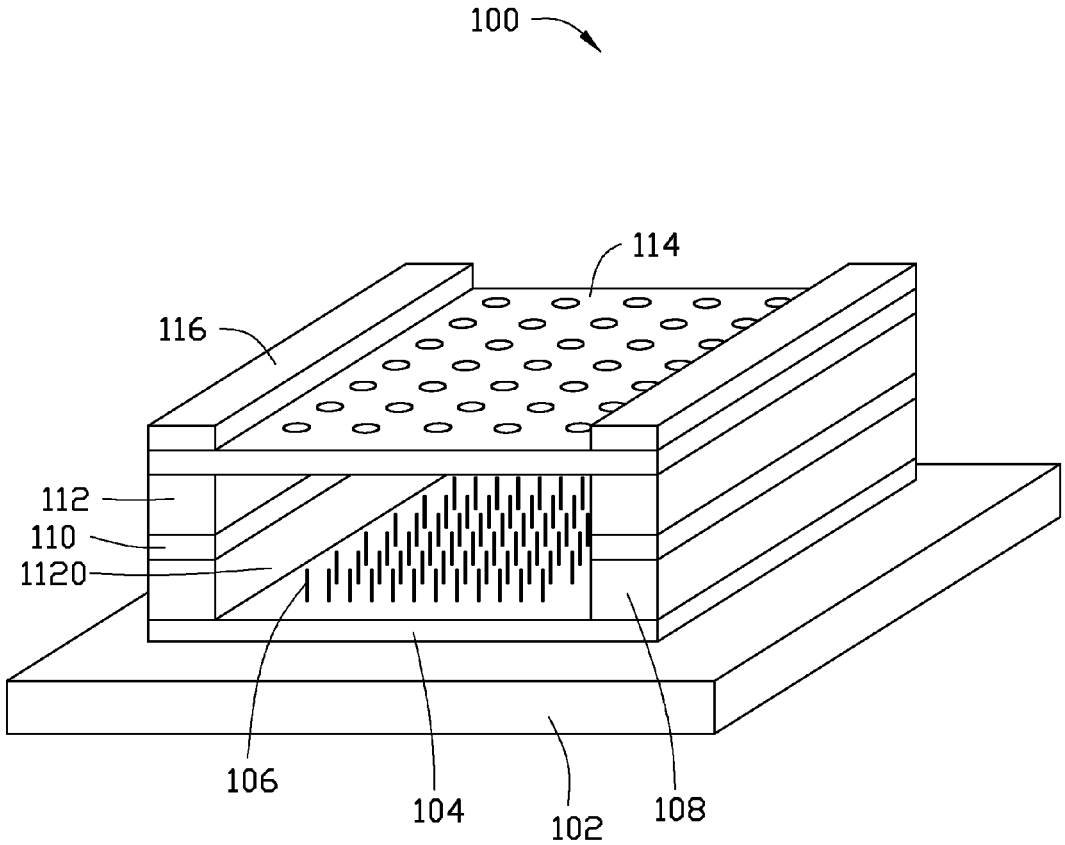
FIG. 2 is a three-dimensional schematic view of one embodiment of the field emission cathode device of FIG. 1.

Referring to FIGS. 1 and 2, a field emission cathode device 100 of one embodiment includes an insulating substrate 102, a cathode electrode 104, an electron emission layer 106, a first dielectric layer 108, a first gate electrode 110, a second dielectric layer 112, and a second grid electrode 114.

The cathode electrode 104 is located on a surface of the insulating substrate 102. The first dielectric layer 108 is located on a surface of the cathode electrode 104. The first dielectric layer 108 defines a first opening 1080, such that part of the cathode electrode 104 is exposed through the first opening 1080. The electron emission layer 106 is located on a surface of the cathode electrode 104 and electrically connected to the cathode electrode 104, wherein the surface is exposed through the first opening 1080.

The first gate electrode 110 is located on a surface of the first dielectric layer 108. The first gate electrode 110 is spaced from the cathode electrode 104 by the first dielectric layer 108. The first gate electrode 110 has an opening, such that the electron emission layer 106 is exposed.

The second dielectric layer 112 is located on a surface of the first gate electrode 110, and is spaced from the first dielectric layer 108 by the first gate electrode 110. The second dielectric layer 112 defines a second opening 1120, such that the electron emission layer 106 is exposed. A length of the second opening 1120 can be in a range from about 1 micrometer to about 500 micrometers. A height of the second opening 1120 can be in a range from about 1 micrometer to about 500 micrometers. In one embodiment, the length of the second opening 1120 is 300 micrometers, and the height of the second opening 1120 is 100 micrometers.

The second grid electrode 114 is located on a surface of the second dielectric layer 112, and is spaced from the first gate electrode 110 by the second dielectric layer 112. The second grid electrode 114 that extends from the second dielectric layer 112 and is opposite to the electron emission layer 106 covers the second opening 1120. The field emission cathode device 100 further includes a fixing element 116 located on a surface of the second grid electrode 114. The fixing element 116 is used to fix the second grid electrode 114 on the second dielectric layer 112.

The first dielectric layer 108 can be directly located on the cathode electrode 104 or directly located on the insulating substrate 102. The size and shape of the first dielectric layer 108 and the second dielectric layer 112 can be chosen according to need. The first dielectric layer 108 is located between the cathode electrode 104 and the first gate electrode 110, such that there is insulation between the cathode electrode 104 and the first gate electrode 110. The second dielectric layer 112 is located between the first gate electrode 110 and the second grid electrode 114 as insulation between the first gate electrode 110 and the second grid electrode 114.

The first dielectric layer 108 can be a layer structure having the first opening 1080. The second dielectric layer 112 can be a layer structure having the second opening 1120. The first dielectric layer 108 can be a plurality of strip-shaped structures spaced from each other. A gap between two adjacent strip-shaped structures is the first opening 1080. The second dielectric layer 112 can be a plurality of strip-shaped structures spaced from each other. A gap between two adjacent strip-shaped structures is the second opening 1120.

The first gate electrode 110 can be a grid electrode or a plurality of strip-shaped electrodes. There is a distance between two adjacent strip-shaped electrodes. The electron emission layer 106 is exposed through the distance between two adjacent strip-shaped electrodes. A part of the gate electrode 110 opposite to the electron emission layer 106 can be a grid electrode.

The second grid electrode 114 can be a plane structure and has a plurality of meshes. The shape of the plurality of meshes can be chosen according to need. An area of each of the plurality of meshes can be in a range from about 1 square micron to about 800 square microns, such as about 10 square microns, about 50 square microns, about 100 square microns, about 150 square microns, about 200 square microns, about 250 square microns, about 350 square microns, about 450 square microns, about 600 square microns. When the first gate electrode 110 is a grid electrode, transparency of the first gate electrode 110 and the second grid electrode 114 can be in a range from about 10% to about 99%, such as about 20%, about 40%, about 50%, about 80%. In one embodiment, when the first gate electrode 110 is a grid electrode, an area of each mesh of the first gate electrode 110 is greater than an area of each mesh of the second grid electrode 114. In one embodiment, when the first gate electrode 110 is a grid electrode, the transparency of the first gate electrode 110 is less than or equal to transparency of the second grid electrode 114. The difference between transparency of the first gate electrode 110 and transparency of the second grid electrode 114 is in a range from about 0% to about 10%.

A material of the insulating substrate 102 can be ceramics, glass, resins, quartz, or polymer. The size, shape, and thickness of the insulating substrate 102 can be chosen according to need. The insulating substrate 102 can be a square plate, a round plate or a rectangular plate. In one embodiment, the insulating substrate 102 is a square glass plate, wherein the length of side of the square glass plate is about 10 millimeters, and the thickness of the square glass plate is about 1 millimeter.

The cathode electrode 104 can be a conductive layer or a conductive plate. The size, shape, and thickness of the cathode electrode 104 can be chosen according to need. The cathode electrode 104 can be made of metal, alloy, conductive slurry, or indium tin oxide (ITO). In one embodiment, the cathode electrode 104 is an aluminum layer with a thickness of about 1 micrometer.

The electron emission layer 106 can include a number of electron emitters such as carbon nanotubes, carbon nanofibers, or silicon nanowires. Each of the electron emitters has an electron emission tip. The size, shape, and thickness of the electron emission layer 106 can be chosen according to need. Furthermore, the electron emission layer 106 can be coated with a protective layer (not shown). The protective layer can be made of anti-ion bombardment materials such as zirconium carbide, hafnium carbide, and lanthanum hexaborid. The protective layer can be coated on a surface of each of the electron emitters. The electron emission layer 106 can be comprised of a number of carbon nanotubes and a glass layer. The carbon nanotubes are electrically connected to the cathode electrode 104. The glass layer fixes the carbon nanotubes on the cathode electrode 104. The electron emission layer 106 is formed by heating a carbon nanotube slurry layer. The carbon nanotube slurry layer includes a number of carbon nanotubes, a glass powder, and an organic carrier. The organic carrier is volatilized during the heating process. The glass powder is melted and solidified to form a glass layer to fix the carbon nanotubes on the cathode electrode 104 during the heating and cooling process.

The first dielectric layer 108 and the second dielectric layer 112 can be made of resin, glass, ceramic, oxide, photosensitive emulsion, or combination thereof. The oxide can be silicon dioxide, aluminum oxide, or bismuth oxide, or combination thereof. The size and shape of the first dielectric layer 108 and the second dielectric layer 112 can be chosen according to need. In one embodiment, the first dielectric layer 108 and the second dielectric layer 112 are a ring-shaped SU-8 photosensitive emulsion with a thickness of about 100 micrometers. In one embodiment, the first opening 1080 and the second opening 1120 are substantially coaxial and have approximately the same diameter.

The first gate electrode 110 and the second grid electrode 114 can be made of metal, alloy, conductive slurry, carbon nanotube, or ITO. The metal can be copper, aluminum, gold, silver, or iron. The conductive slurry can include metal powder of about 50% to about 90% by weight, glass powder of about 2% to about 10% by weight, and binder of about 8% to about 40% by weight. If the insulating substrate 102 is a silicon wafer covered with insulation layer, the first gate electrode 110 can be a doped layer. A thickness of the first gate electrode 110 and the second grid electrode 114 can be greater than or equal to 10 nanometers. In one embodiment, the thickness of the first gate electrode 110 and the second grid electrode 114 are in a range from about 30 nanometers to about 60 nanometers. In one embodiment, the first gate electrode 110 is a grid electrode, the first gate electrode 110 and the second grid electrode 114 are made of at least two stacked carbon nanotube films. The carbon nanotube film includes a plurality of successive and oriented carbon nanotubes joined end-to-end by van der Waals attractive force therebetween. An angle between the aligned directions of the carbon nanotubes in two adjacent carbon nanotube films can be in a range from about 0 degrees to about 90 degrees.

The fixing element 116 can be made of insulating material. A thickness of the fixing element 116 can be chosen according to need. The shape of the fixing element 116 is the same as the shape of the second dielectric layer 112. The fixing element 116 defines a third opening 1160 opposite to the second opening 1120, such that the second grid electrode 114 is exposed through the third opening 1160. In one embodiment, the fixing element 116 is insulating slurry layer. A size of the first opening 1080 and a size of the second opening 1120 are about the same as a size of the third opening 1160. In one embodiment, the width of the first opening 1080, the width of the second opening 1120, and the width of the third opening 1160 are about 50 micrometers.

Figure 7:
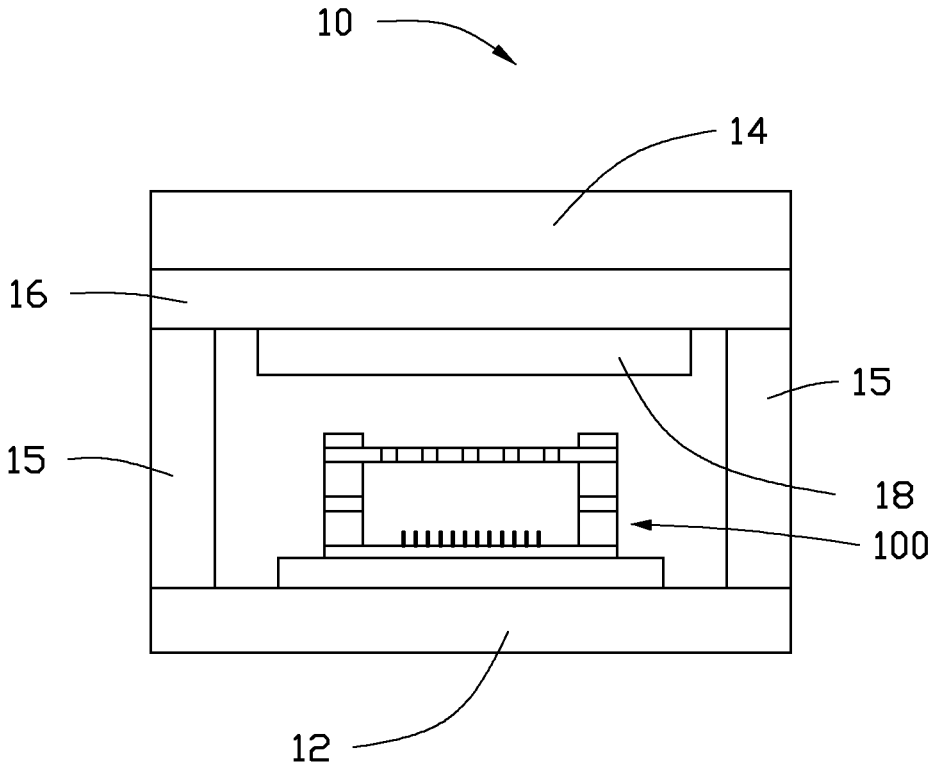
FIG. 7 is a schematic view of one embodiment of a pixel unit of a field emission display including the field emission cathode device of FIG. 1.

Referring to FIG. 7, a field emission display 10 of one embodiment includes a cathode substrate 12, an anode substrate 14, an anode electrode 16, a fluorescent layer 18, and the field emission cathode device 100.

The cathode substrate 12 and the anode substrate 14 are spaced from each other by an insulating supporter 15. The cathode substrate 12, the anode substrate 14 and the insulating supporter 15 form a space. The field emission cathode device 100, the anode electrode 16, and the fluorescent layer 18 are accommodated in the space. The anode electrode 16 is located on a surface of the anode substrate 14. The fluorescent layer 18 is located on a surface of the anode electrode 16. The field emission cathode device 100 is located on a surface of the cathode substrate 12. There is a distance between the fluorescent layer 18 and the field emission cathode device 100. In one embodiment, the cathode substrate 12 is the insulating substrate 102.

The cathode substrate 12 can be made of insulating material. The insulating material can be ceramics, glass, resins, quartz, or polymer. The anode substrate 14 is a transparent plate. The thickness, size and shape of the anode substrate 14 can be selected according to need. In one embodiment, the cathode substrate 12 and the anode substrate 14 are a glass plate. The anode electrode 16 is an ITO film with a thickness of about 100 micrometers. The fluorescent layer 18 can be round shape. The diameter of the fluorescent layer 18 can be greater than or equal to the inner diameter of the electron emission layer 106 and less than or equal to the outer diameter of the electron emission layer 106. In one embodiment, the fluorescent layer 18 is round and has a diameter substantially equal to the outer diameter of the electron emission layer 106.

Figure 3:
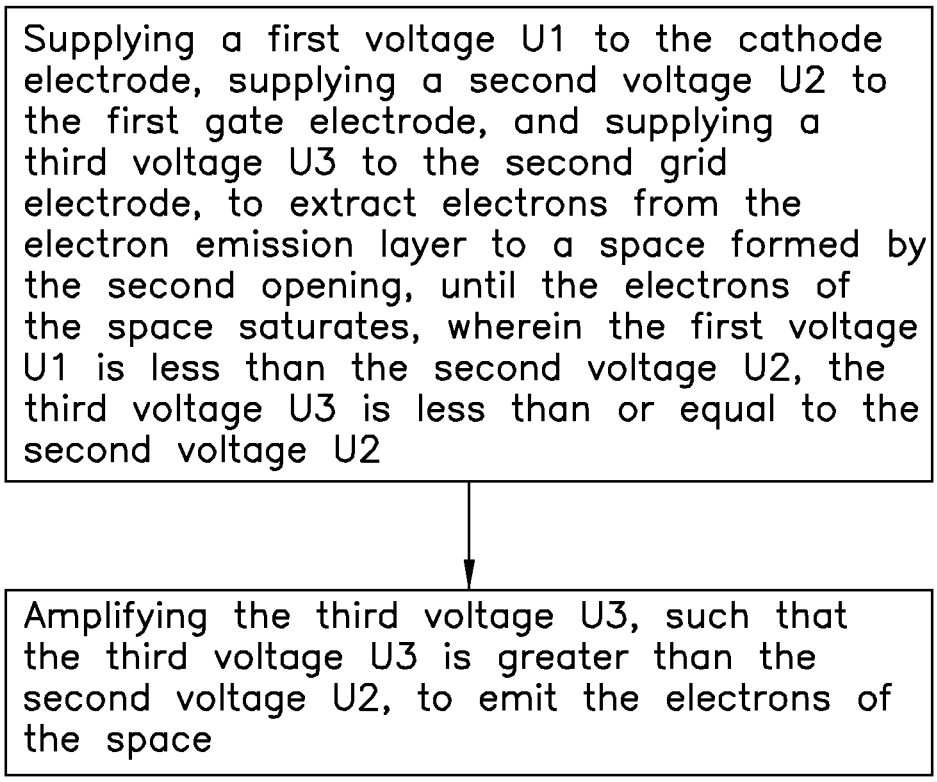
FIG. 3 is a flowchart of one embodiment of a driving method of the field emission cathode device of FIG. 1.

Referring to FIG. 3, a driving method of the field emission cathode device 100 of one embodiment includes steps of:

(S1), supplying a first voltage U1 to the cathode electrode 104, supplying a second voltage U2 to the first gate electrode 110, and supplying a third voltage U3 to the second grid electrode 114, to extract electrons from the electron emission layer 106 to a space formed by the second opening 1120, until the electrons in the space saturate, wherein the first voltage U1 is less than the second voltage U2, the third voltage U3 is less than or equal to the second voltage U2; and (S2), amplifying the third voltage U3, such that the third voltage U3 is greater than the second voltage U2, to emit the electrons of the space.

In the step (S1), the first voltage U1, the second voltage U2 and the third voltage U3 can be positive voltage or negative voltage. The first voltage U1 can be about 0 volt. The second voltage U2 can be in a range from about 30 volts to about 300 volts. The third voltage U3 can be in a range from about −100 volts to about 250 volts.

In the step (S1), the electrons extracted from the electron emission layer 106 emit to the space formed by the second opening 1120 through the first gate electrode 110, because the first voltage U1 is less than the second voltage U2. The electrons extracted from the electron emission layer 106 do not emit through the second grid electrode 114, because the third voltage U3 is less than or equal to the second voltage U2. The second grid electrode 114 covers the electron emission layer 106. Therefore, equipotential lines of the second grid electrode 114 is substantially parallel to the electron emission layer 106, causing the electrons extracted from the electron emission layer 106 to be in the space formed by the second opening 1120 but not emit through the second grid electrode 114.

In the step (S2), the electrons of the space are controlled to emit through the second grid electrode 114 by adjusting the third voltage U3. The emission of the electrons of the space is not controlled by the electron emission layer 106. The emission of the electrons of the space is controlled by the third voltage U3, improving uniformity and stability of the emission of the electrons.

Figure 4:
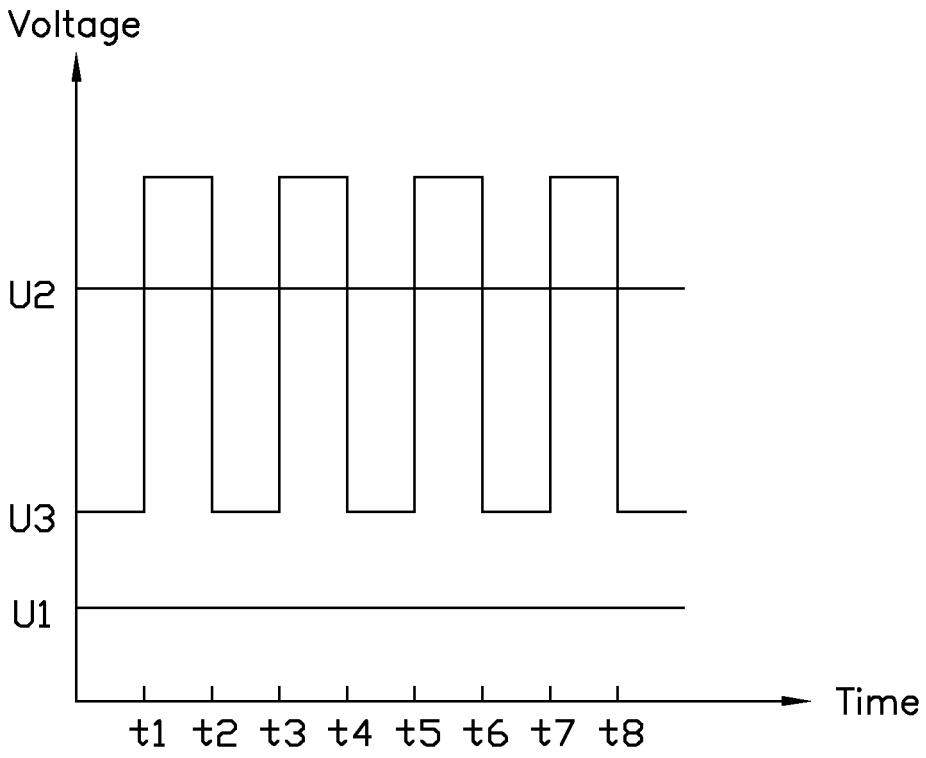
FIG. 4 is a voltage-time curve of one embodiment of the field emission cathode device of FIG. 1 in operation.

The third voltage U3 supplied to the second grid electrode 114 can be an impulse voltage, as shown in FIG. 4.

A field emission display 10 includes the field emission cathode device 100. If a voltage supplied to the anode electrode 16 is large enough, even though the third voltage U3 is less than or equal to the second voltage U2, the electrons of the space can pass through the second grid electrode 114 to bombard the anode electrode 16.

Figure 5:
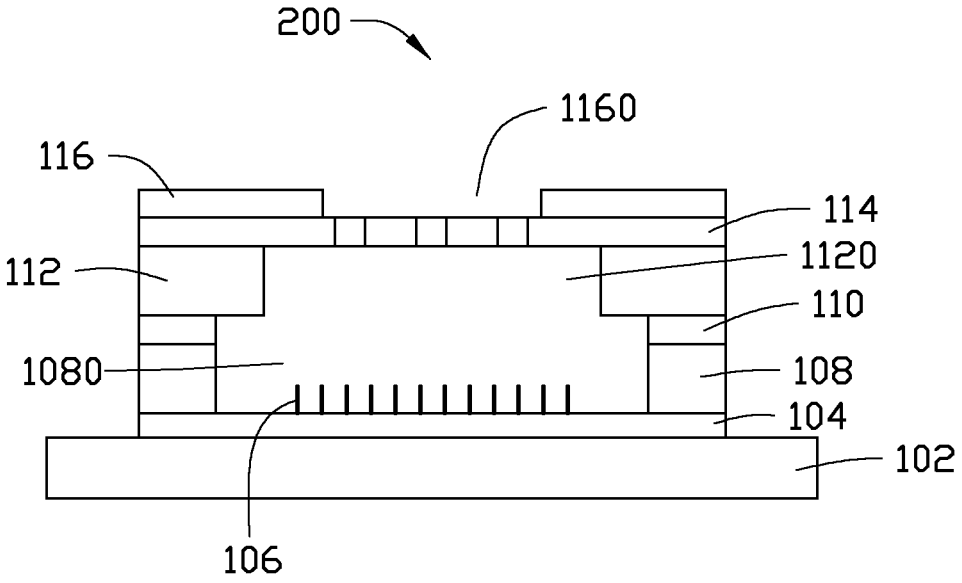
FIG. 5 is a schematic view of another embodiment of a field emission cathode device.

Referring to FIG. 5, an embodiment of the field emission cathode device 200 is shown where the width of the first opening 1080 is greater than the width of the second opening 1120, and the width of the second opening 1120 is greater than the width of the third opening 1160. The width of the first opening 1080 can be in a range from about 60 micrometers to about 80 micrometers. The width of the second opening 1120 can be in a range from about 50 micrometers to about 70 micrometers. The width of the third opening 1160 can be in a range from about 30 micrometers to about 50 micrometers.

Figure 6:
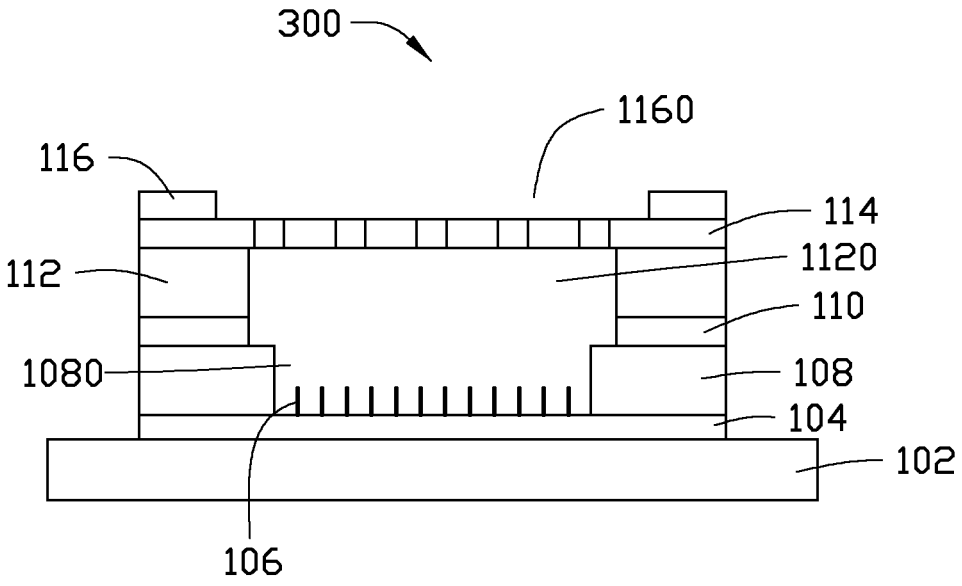
FIG. 6 is a schematic view of yet another embodiment of a field emission cathode device.

Referring to FIG. 6, an embodiment of the field emission cathode device 300 is shown where the width of the first opening 1080 is less than the width of the second opening 1120, and the width of the second opening 1120 is less than the width of the third opening 1160. The width of the first opening 1080 can be in a range from about 30 micrometers to about 50 micrometers. The width of the second opening 1120 can be in a range from about 50 micrometers to about 70 micrometers. The width of the third opening 1160 can be in a range from about 60 micrometers to about 80 micrometers.

In summary, the emission of the electrons of the space formed by the second opening 1120 is not controlled by the electron emission layer 106 and is only controlled by the third voltage U3, improving uniformity and stability of the emission of the electrons. Furthermore, when the first gate electrode 110 is a grid electrode, accordingly, the uniformity and density of the emission of the electrons of the space will be improved. Moreover, when the first gate electrode 110 is a grid electrode, and the area of each mesh of the first gate electrode 110 is greater than the area of each mesh of the second grid electrode 114, penetration probability of the electrons from the electron emission layer 106 to the space is improved. The penetration probability of the electrons from the space to the anode electrode 16 is reduced. Therefore, the emission of the electrons of the space is only controlled by the third voltage U3 supplied to the second grid electrode 114, further improving uniformity and stability of the emission of the electrons.

It is to be understood that the above-described embodiment is intended to illustrate rather than limit the disclosure. Variations may be made to the embodiment without departing from the spirit of the disclosure as claimed. The above-described embodiments are intended to illustrate the scope of the disclosure and not restricted to the scope of the disclosure.

It is also to be understood that the above description and the claims drawn to a method may include some indication in reference to certain steps. However, the indication used is only to be viewed for identification purposes and not as a suggestion as to an order for the steps.

What is claimed is:

1. A driving method, comprising steps of:

providing a field emission cathode device, the field emission cathode device comprising:

a cathode electrode;

an electron emission layer electrically connected to the cathode electrode;

a first gate electrode spaced from the cathode electrode by a first dielectric layer, wherein the first gate electrode has an opening opposite to the electron emission layer; and a second grid electrode located on a surface of the first gate electrode away from the cathode electrode and spaced from the first gate electrode by a second dielectric layer, wherein the second dielectric layer has a second opening such that a part of the cathode electrode is exposed, and the second grid electrode has a mesh opposite to the electron emission layer;

supplying a first voltage to the cathode electrode, supplying a second voltage to the first gate electrode, and supplying a third voltage to the second grid electrode, to extract electrons from the electron emission layer to a space formed by the second opening, until the electrons of the space saturate, wherein the first voltage is less than the second voltage, and the third voltage is less than or equal to the second voltage; and amplifying the third voltage after the electrons of the space saturate, such that the third voltage is greater than the second voltage and the electrons of the space are emitted through the second grid electrode.

2. The field emission cathode device of claim 1, wherein the first gate electrode is a grid electrode and covers the first opening.

3. The field emission cathode device of claim 2, wherein a transparency of the first gate electrode is less than or equal to a transparency of the second grid electrode.

4. The field emission cathode device of claim 3, wherein the difference between the transparency of the first gate electrode and the transparency of the second grid electrode is in a range from about 0 to about 10%.

5. The field emission cathode device of claim 1, wherein the first gate electrode and the second grid electrode are made of at least two stacked carbon nanotube films.

6. The field emission cathode device of claim 5, wherein the carbon nanotube film comprises a plurality of successive and oriented carbon nanotubes joined end-to-end by van der Waals attractive force therebetween.

7. The field emission cathode device of claim 6, wherein an angle between aligned directions of the carbon nanotubes in two adjacent carbon nanotube films is in a range from about 0 degree to about 90 degrees.

8. The field emission cathode device of claim 1, wherein the first voltage is about 0 volt, the second voltage is in a range from about 30 volts to about 300 volts, and the third voltage is in a range from about −100 volts to about 250 volts.

9. A driving method, comprising steps of:

providing a field emission cathode device, the field emission cathode device comprising:

a cathode electrode;

an electron emission layer electrically connected to the cathode electrode;

a first gate electrode spaced from the cathode electrode by a first dielectric layer, wherein the first gate electrode has an opening opposite to the electron emission layer; and a second grid electrode located on a surface of the first gate electrode away from the cathode electrode and spaced from the first gate electrode by a second dielectric layer, wherein the second dielectric layer has a second opening such that a part of the cathode electrode is exposed, and the second grid electrode has a mesh opposite to the electron emission layer;

supplying a first voltage to the cathode electrode, supplying a second voltage to the first gate electrode, and supplying a third voltage to the second grid electrode, to extract electrons from the electron emission layer to a space formed by the second opening, until the electrons of the space saturates, wherein the first voltage is less than the second voltage, and the third voltage is less than or equal to the second voltage; and providing an anode electrode supplied a voltage after the electrons of the space saturate, such that the electrons of the space are emitted through the second grid electrode.

10. The field emission cathode device of claim 9, wherein the first voltage is about 0 volt, the second voltage is in a range from about 30 volts to about 300 volts, and the third voltage is in a range from about −100 volts to about 250 volts.

11. The field emission cathode device of claim 9, wherein the first gate electrode and the second grid electrode are made of at least two stacked carbon nanotube films.

12. The field emission cathode device of claim 1, wherein before amplifying the third voltage, equipotential lines of the second grid electrode is substantially parallel to the electron emission layer, causing the electrons extracted from the electron emission layer to be in the space but not emit through the second grid electrode.

13. The field emission cathode device of claim 1, wherein the electrons of the space are controlled to emit through the second grid electrode by adjusting the third voltage, and the emission of the electrons of the space is not controlled by the electron emission layer.

14. A field emission cathode device, comprising:

an insulating substrate;

a cathode electrode located on a surface of the insulating substrate;

a first dielectric layer located on a surface of the cathode electrode or the surface of the insulating substrate, wherein the first dielectric layer defines a first opening such that part of the cathode electrode is exposed;

an electron emission layer located on the surface of the cathode electrode and electrically connected to the cathode electrode, wherein the surface of the cathode electrode is exposed through the first opening;

a first gate electrode located on a surface of the first dielectric layer;

a second dielectric layer located on a surface of the first gate electrode and defined a second opening, a part of the cathode electrode is exposed; and a second grid electrode extending from the second dielectric layer and opposite to the electron emission layer, wherein the second grid electrode covers the second opening, the second grid electrode has a mesh opposite to the electron emission layer, the first gate electrode is a grid electrode, a transparency of the first gate electrode is less than a transparency of the second grid electrode, and an area of each mesh of the first gate electrode is greater than an area of each mesh of the second grid electrode.

15. The field emission cathode device of claim 14, wherein the difference between the transparency of the first gate electrode and the transparency of the second grid electrode is in a range from about 0 to about 10%.

16. The field emission cathode device of claim 14, wherein the first gate electrode and the second grid electrode are made of alloy, conductive slurry, carbon nanotube, or ITO.

17. The field emission cathode device of claim 16, wherein the first gate electrode and the second grid electrode are made of at least two stacked carbon nanotube films, and the carbon nanotube film comprises a plurality of successive and oriented carbon nanotubes joined end-to-end by van der Waals attractive force therebetween.

18. The field emission cathode device of claim 17, wherein an angle between aligned directions of the carbon nanotubes in two adjacent carbon nanotube films is in a range from about 0 degrees to about 90 degrees.

19. The field emission cathode device of claim 14, wherein thicknesses of the first dielectric layer and the second dielectric layer are about 100 micrometers.

20. The field emission cathode device of claim 14, wherein an opening is defined in the first gate electrode, a width of the opening is greater than or equal to a width of the second opening.

* * * * *